US007422529B2

(12) United States Patent
Aoyama et al.

(10) Patent No.: US 7,422,529 B2
(45) Date of Patent: Sep. 9, 2008

(54) MOLD FOR A GOLF BALL

(75) Inventors: Steven Aoyama, Marion, MA (US); Paul A. Puniello, Bristol, RI (US); Robert A. Wilson, Sagamore, MA (US)

(73) Assignee: Acushnet Company, Fairhaven, MA (US)

( * ) Notice: Subject to any disclaimer, the term of this patent is extended or adjusted under 35 U.S.C. 154(b) by 540 days.

(21) Appl. No.: 10/797,796

(22) Filed: Mar. 10, 2004

(65) Prior Publication Data

US 2005/0201418 A1 Sep. 15, 2005

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 4,653,758 | A | 3/1987 | Solheim | 273/232 |
| 5,201,523 | A | 4/1993 | Miller | 273/233 |
| 5,249,804 | A | 10/1993 | Sanchez | 473/379 |
| 5,494,631 | A | 2/1996 | Oka et al. | 264/161 |
| 5,688,193 | A | 11/1997 | Kasasima et al. | 473/379 |
| 5,827,135 | A | 10/1998 | Shimosaka et al. | 473/379 |
| 5,840,351 | A | 11/1998 | Inoue et al. | 425/556 |
| 5,874,038 | A | 2/1999 | Kasashima et al. | 264/279 |
| 5,947,844 | A | 9/1999 | Shimosaka et al. | 473/379 |
| 6,123,534 | A | 9/2000 | Kasashima et al. | 425/116 |
| 6,200,232 | B1 | 3/2001 | Kasashima et al. | 473/384 |
| 6,207,095 | B1 | 3/2001 | Gosetti | 264/250 |
| 6,461,253 | B2 | 10/2002 | Ogg | 473/378 |
| 6,632,078 | B2 | 10/2003 | Ogg et al. | 425/116 |
| 6,685,455 | B2 | 2/2004 | Ogg | 425/116 |
| 6,685,456 | B2 | 2/2004 | Sajima | 473/378 |
| 2002/0019274 | A1 * | 2/2002 | Sajima | 473/378 |

* cited by examiner

*Primary Examiner*—Raeann Trimiew
(74) *Attorney, Agent, or Firm*—D. Michael Burns

(57) ABSTRACT

An improved mold for making a golf ball comprises a pair of mold cups which are assembled together at an angular interlock. An upper mold cup has a projection rim that mates with a recess in the lower mold cup to provide for a substantially perfect registration, wherein the shift on the molded golf ball is minimized, and the parting line has a minimal amount of flashing that needs to be removed. The upper and lower mold cups have mating surfaces that can produce a corrugated parting line. Each mating surface comprising a plurality of peaks and valleys which are created by multiple radii, whereby when assembled the parting line follows the dimple outline pattern and allows the dimple outline pattern of one mold cup to interdigitate with the dimple outline pattern of the mating mold cup, to form a golf ball of substantially seamless appearance.

1 Claim, 8 Drawing Sheets

MOLD FOR A GOLF BALL

FIELD OF INVENTION

The invention relates in general to a mold for making a golf ball, and more particularly, to an improved golf ball mold for forming a golf ball having a parting line based on waveforms.

BACKGROUND OF THE INVENTION

The usual golf ball manufacturing techniques include several different steps, depending on the type of ball, such as one, two, three or even more than three piece balls. According to the traditional method, a solid or composite elastomeric core is made, and an outer dimpled cover is formed around the core.

The two standard methods for molding a cover over a core or a core and inner layers is by compression molding or injection molding. The compression molding operation is accomplished by using a pair of hemispherical molds each of which has an array of protrusions machined or otherwise provided in its cavity, and those protrusions form the dimple pattern on the periphery of the golf ball during the cover molding operation. A pair of hemispherical cover blanks, are placed in a diametrically opposed position on the golf ball body, and the body with the cover blanks thereon are placed in the hemispherical molds, and then subjected to a compression molding operation. The combination of heat and pressure applied during the molding operation results in the cover blanks being fused to the golf ball body and to each other to form a unitary one-piece cover structure which encapsulates the golf ball body. In addition, the cover blanks are simultaneously molded into conformity with the interior configuration of the hemispherical molds which results in the formation of the dimple pattern on the periphery of the golf ball cover. When dimple projections are machined in the mold cavity they are typically positioned below the theoretical parting line of the resulting mold cavity. The parting line is typically finished machined after the dimple forming process. For ease of manufacturing the parting line on he cavity is machined flat and perpendicular to the dimpled surface as to provide a positive shut off preventing flowing cover material from leaking out of the mold. This dimple positioning and flat parting line results in a great circle path on the ball that is essentially void of dimples. This is commonly referred to as the equator, parting line, or seam of the ball. Over the years dimple patterns have been developed to compensate for cosmetics and/or flight performance issues due to the presence of the seam.

As in all molding operations, when the golf ball is removed from the hemispherical molds subsequent to the molding operation, it will have molding flash, and possibly other projecting surface imperfections thereon. The molding flash will be located at the fused circular junction of the cover blanks and the parting line of the hemispherical molds. The molding flash will therefore be on the "equator" of the golf ball.

The molding flash and possible other projecting surface imperfections, need to be removed and this is normally accomplished by one or a combination of the following: cutting blades, sanding belts, grinding stones, or cryogenics and the like. These types of processes tend to enhance the obviousness of the seam. Alternative finishing processes have been developed to minimize this effect. These processes include tumbling with media, stiff brushes, cryogenic deflashing and the like. Regardless of the finishing process, the result with a flat parting line is an area substantially void of dimple coverage.

When flashing is removed by grinding, it is desirable that the molding operation be accomplished in such a manner that the molding flash is located solely on the surface of the golf ball and does not extend into any of the dimples. In other words, a grinding operation may have difficulty reaching into the dimples of the golf ball to remove the molding flash without ruining the golf ball cover. Therefore, prior art hemispherical molds are primarily fabricated so that the dimple-forming protrusions formed therein are set back from the circular rims, or mouths of their cavities. The result is that the equator of a molded golf ball is devoid of dimples and the molding flash is located solely on the smooth surface provided at the equator of the golf ball.

As it is well known, the dimple pattern of a golf ball is a critical factor insofar as the flight characteristics of the ball are concerned. The dimples influence the lift, drag and flight stability of the golf ball. When a golf ball is struck properly, it will spin about a horizontal axis and the interaction between the dimples and the oncoming air stream will produce the desired lift, drag, and flight stability characteristics.

In order for a golf ball to achieve optimum flight consistency, its dimples must be arranged with multiple axes of symmetry. Otherwise, it might fly differently depending upon orientation. Most prior art golf balls include a single dimple free equatorial parting line, which inherently limits the number of symmetry axes to one. In order to achieve good flight consistency, it is often necessary to compensate for this limitation by adjusting the positions and/or dimensions and/or shapes of certain dimples. Alternatively, additional symmetry axes can be created by incorporating additional dimple free "false" parting lines. However, this practice increases the amount of un-dimpled surface on the ball, which can result in reduced ball flight distance.

For maximum performance and consistency, it is preferable to use a dimple arrangement that requires no adjustment or addition of false parting lines. Therefore, it is preferable to eliminate the equatorial parting line by including dimples that intersect the equator.

Some U.S. patents that seek to place dimples upon the equator of the ball include U.S. Pat. Nos. 6,200,232, 6,123,534 and 5,688,193 to Kasashima et al., U.S. Pat. No. 5,840,351 to Inoue et al., and U.S. Pat. No. 4,653,758 to Solheim. These patents introduced "stepped" and "zig zag" parting lines. While this could potentially improve compliance with the symmetry, they did not sufficiently improve dimple coverage, since the parting lines included straight segments that did not permit interdigitation of dimples from opposite sides of the equator. A stepped path often results in a greater loss of dimple coverage than a straight path because it discourages interdigitation for a larger number of dimples.

Therefore, a need exists for a mold to create a new and improved golf ball, one that would have a parting line configuration that would minimize dimple damage during flash removal, improve symmetry performance, increase dimple coverage, and minimize the visual impact of the equator.

SUMMARY

The present invention provides a mold for forming a cover of a golf ball. The mold comprises hemispherical mold cups, an upper mold cup and a lower mold cup, both cups having interior cavity details, and when assembled create a generally spherical cavity. The mold cups provide a dimple pattern on the golf ball. The upper and lower mold cups have mating surfaces, wherein each surface comprises a plurality of peaks and valleys which are created by multiple radii. When assembled the parting line follows the dimple outline pattern and allows the dimple outline pattern of one mold cup to interdigitate with the dimple outline pattern of the mating mold cup, thereby forming a golf ball of substantially seamless appearance.

Another aspect of the invention is to assemble the mold cups by means of a tapered interlock. The interlock consists of a 360 degree projection rim on one cup mating with a 360 degree recess on the other cup. This interlock provides for a near perfect registration between the cups such that any shift of the molded ball is minimized. To facilitate the interlock, both the projection rim and recess are machined with an angle alignment of about 15 degrees away from the interior cavity details.

The present invention provides for a parting line along the outline pattern of the equator dimples that is preferably offset from the equator dimples by at least 0.001 inch. The parting line produced by the mating surfaces of the cups is a result of a superposition of a base waveform with a secondary waveform that has a wavelength shorter than the base waveform.

One embodiment provides for a secondary waveform that is continuous around the equator of the molded golf ball.

Another embodiment provides for a secondary waveform that is broken into individual segments that are applied in a periodic fashion to the base waveform.

DETAILED DESCRIPTION OF THE INVENTION

The invention comprises a golf ball cavity design that incorporates tapered interlocks for substantially perfect cavity registration. This type of interlock can be used with any type golf ball molding process. It will work with standard flat parting lines as well as corrugated parting lines used to manufacture "seamless" golf balls.

Figure 2:
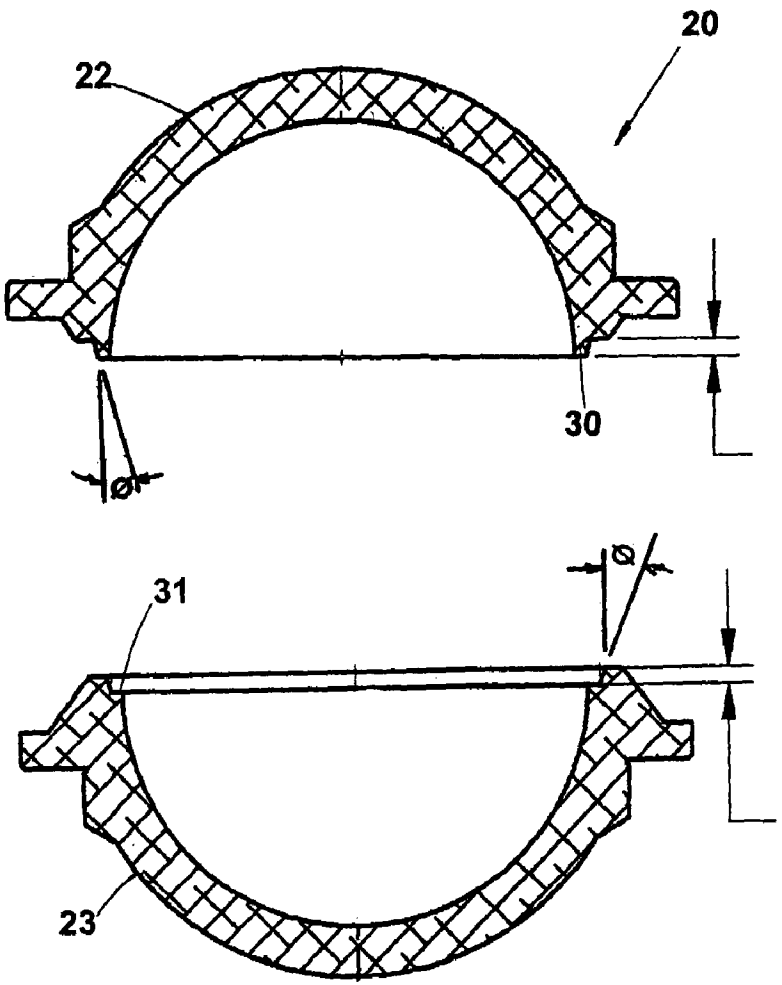
FIG. 2 is an expanded cross section view of the two mold halves.
Figure 1:
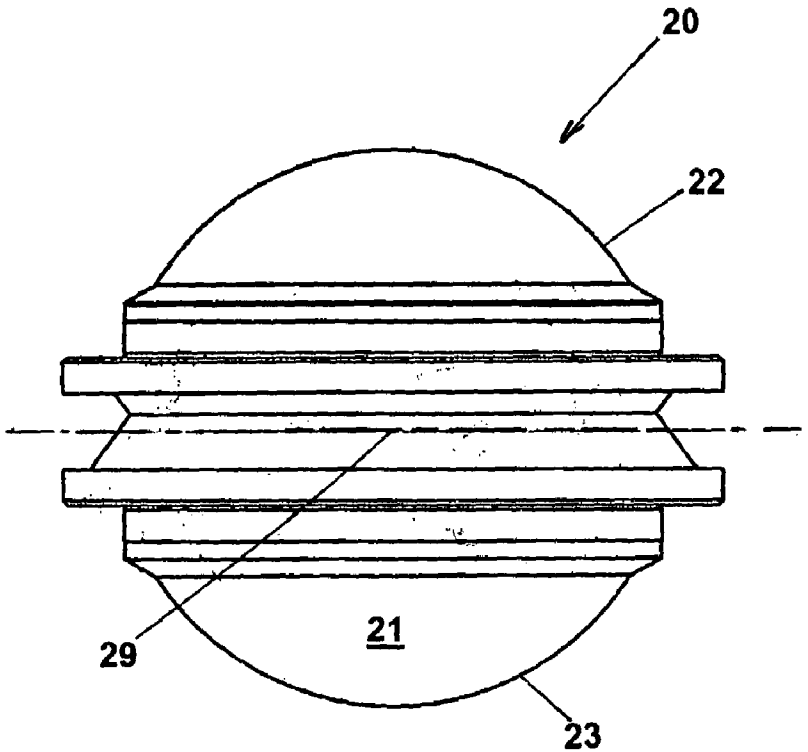
FIG. 1 is an enlarged symmetrical elevation view of the mold comprising both mold halves.
Figure 3:
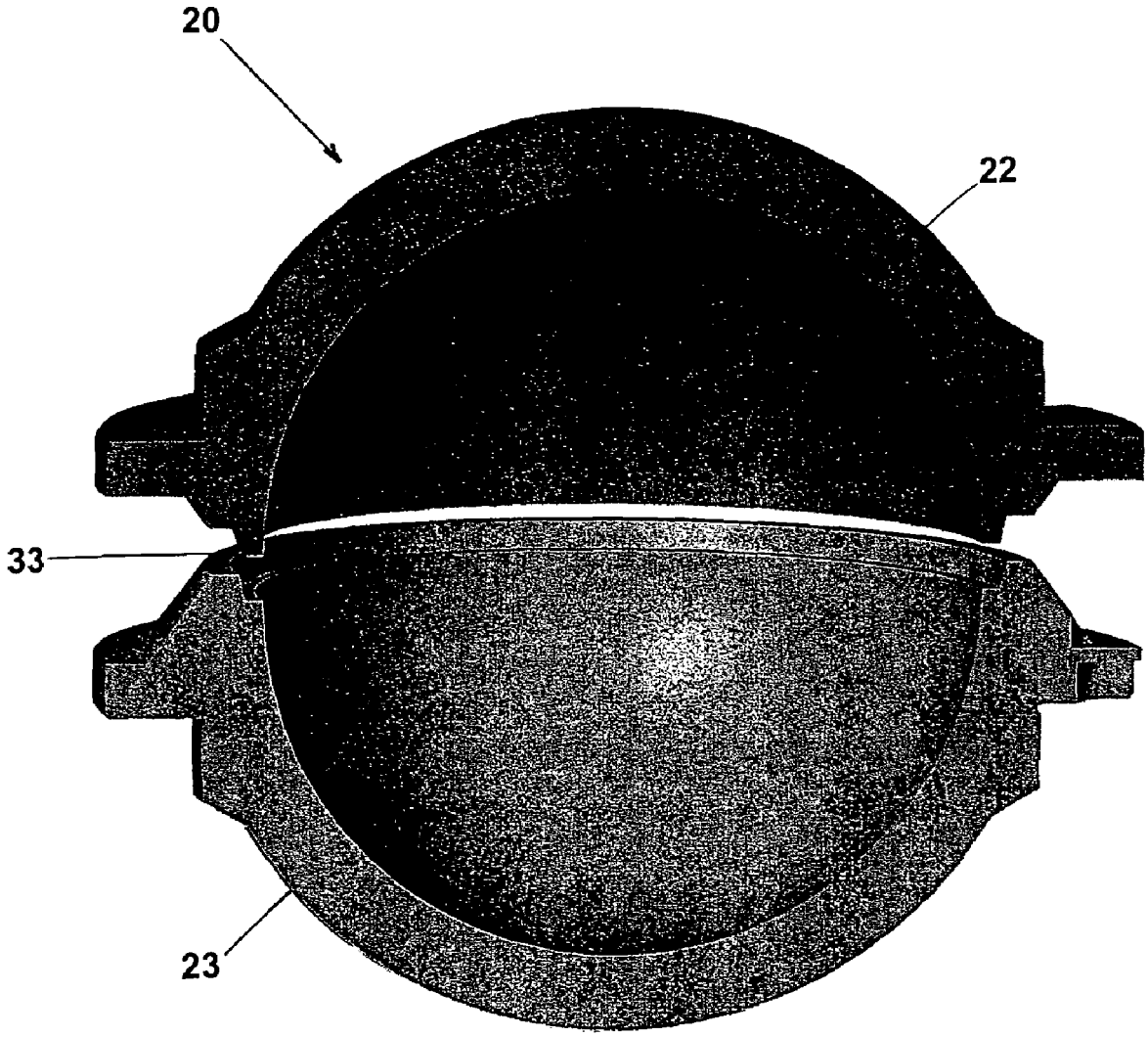
FIG. 3 is an expanded cross section view of two mold halves showing the tapered interlock.
Figure 4:
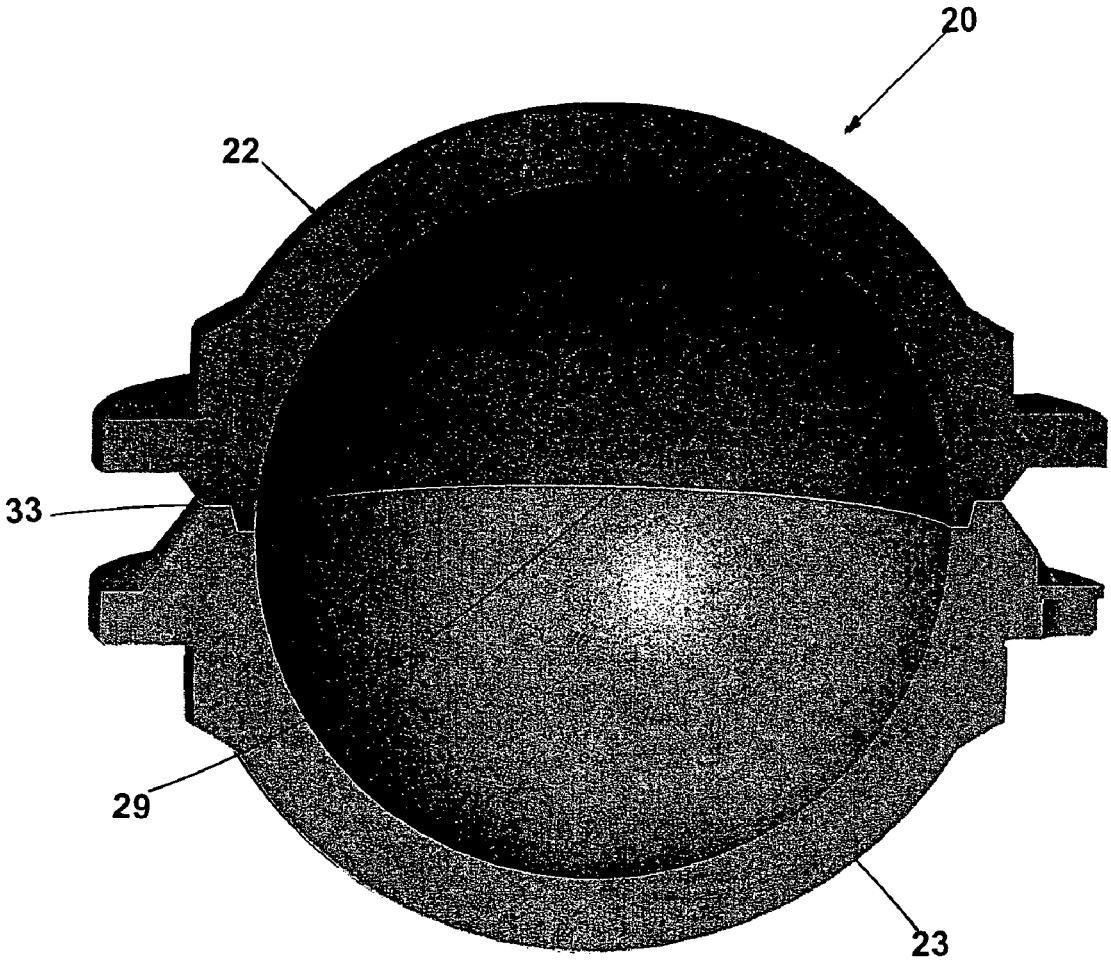
FIG. 4 is a cross section view of the two mold halves of FIG. 1 interlocked.
Figure 5:
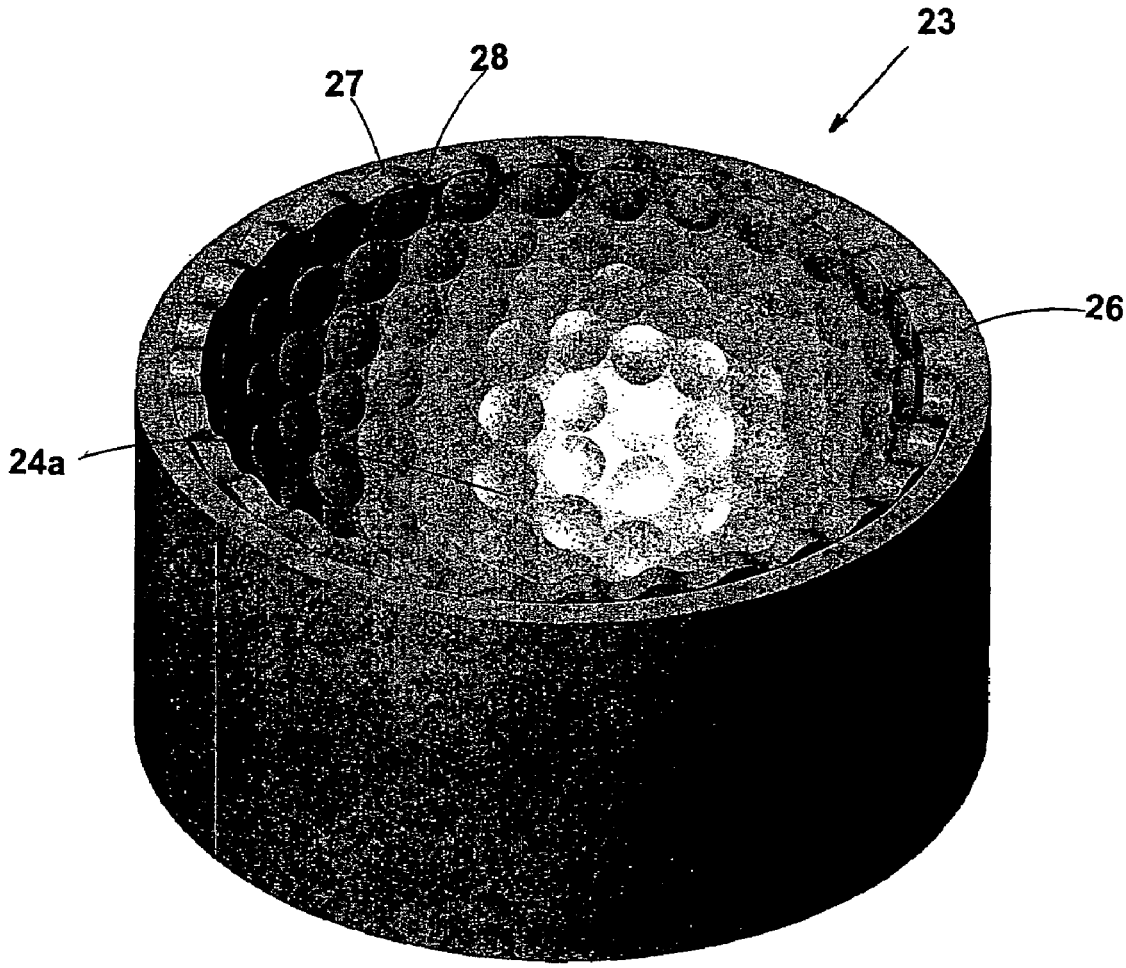
FIG. 5 is a pictorial view of a mold half of an embodiment showing dimple protrusions and indentations.
Figure 6:
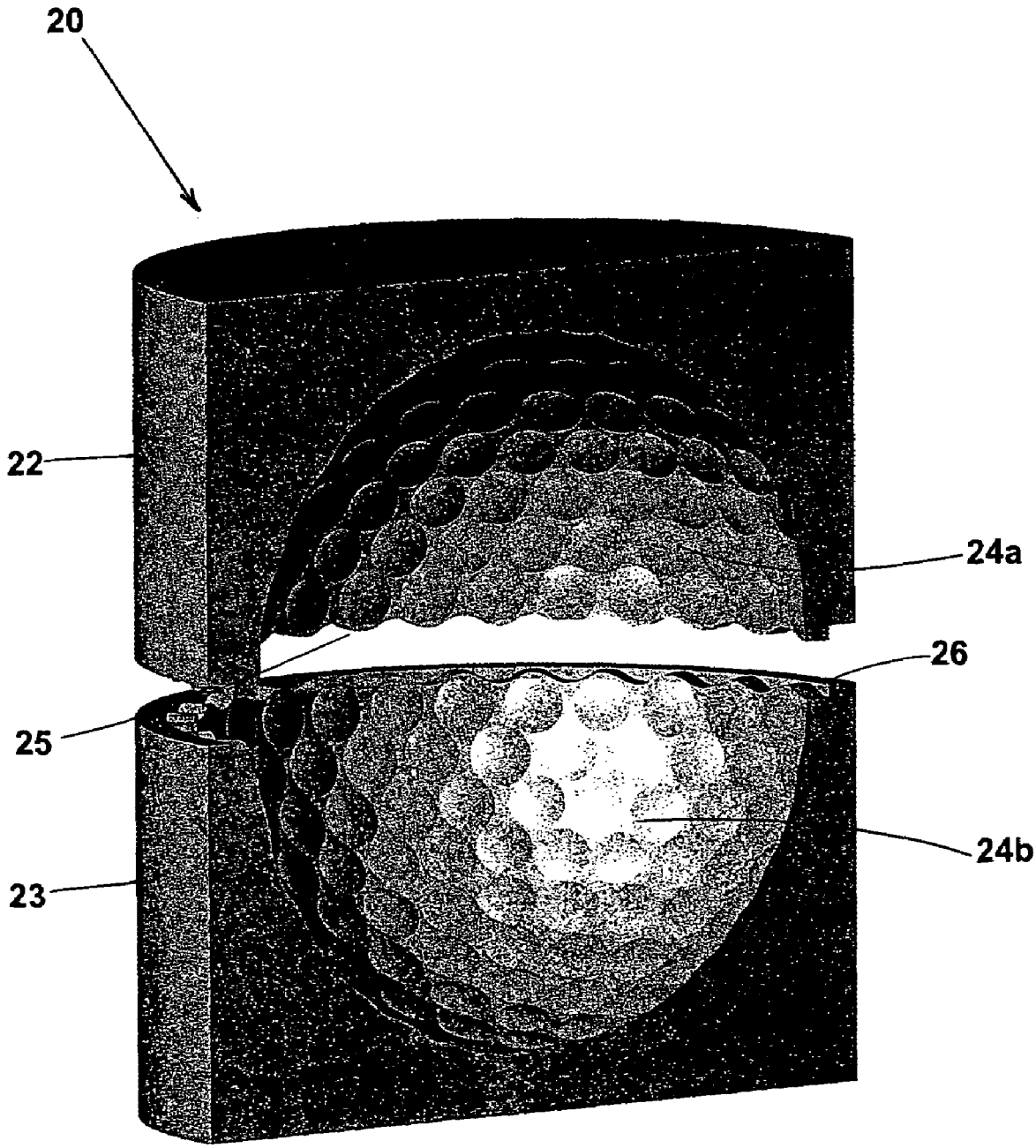
FIG. 6 is a pictorial cross section view of two mold halves having dimple protrusions and indentations.
Figure 8:
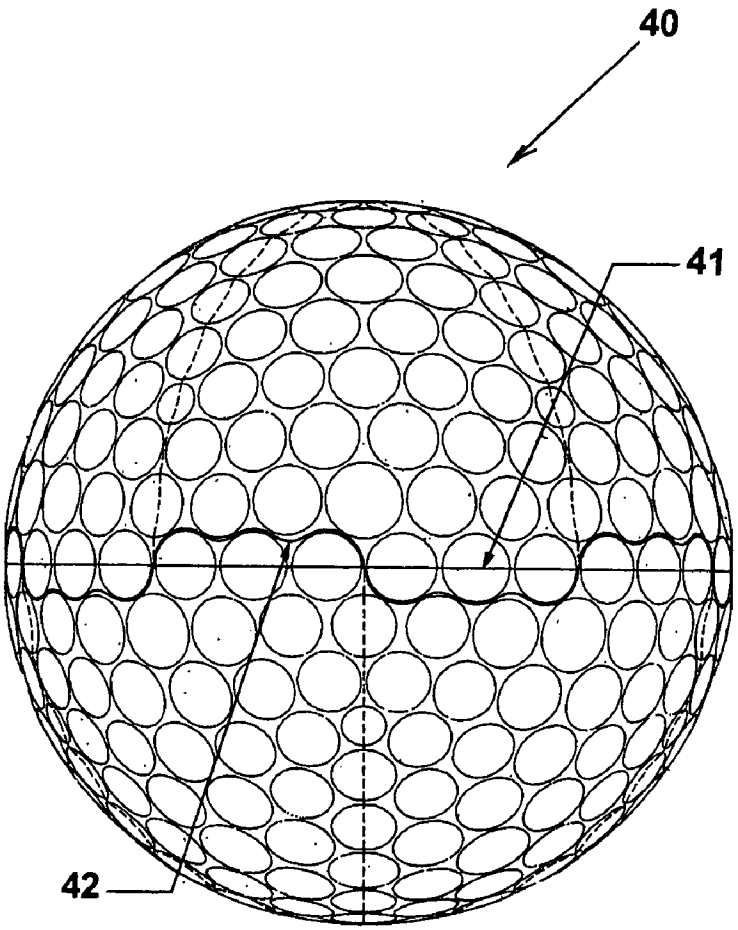
FIG. 8 is an equatorial view of FIG. 7 with the completed parting line resulting from a superposition of secondary waveforms.
Figure 10:
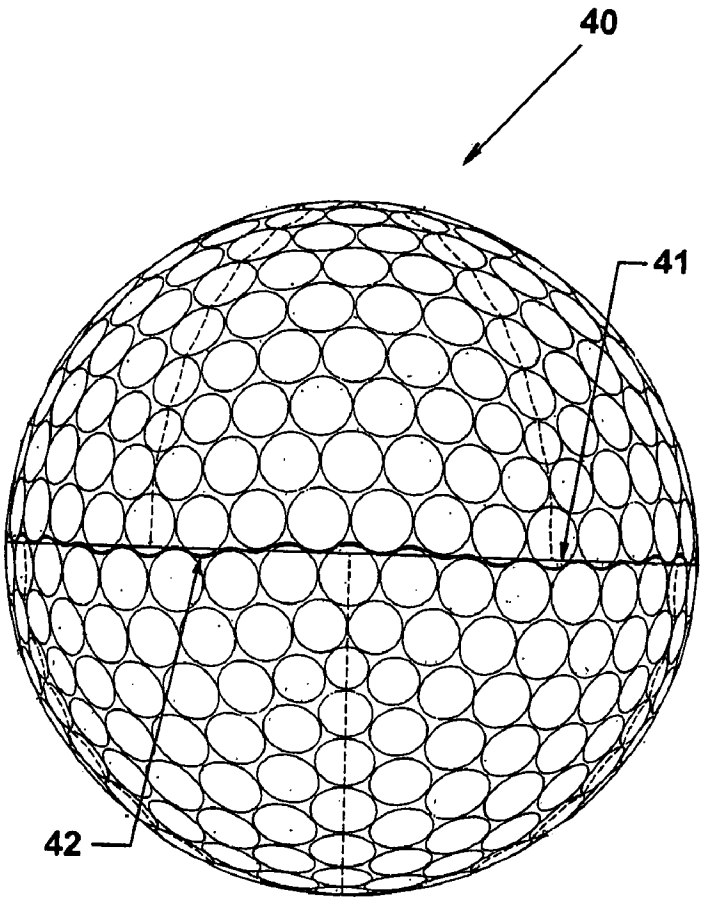
FIG. 10 is an equatorial view of FIG. 9 with the completed parting line resulting from a superposition of secondary waveforms.
Figure 12:
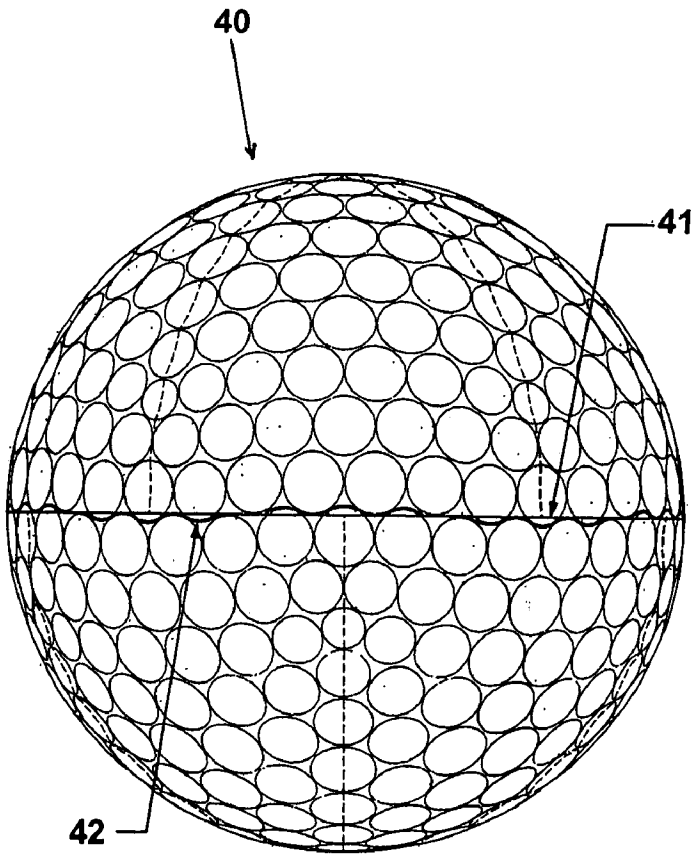
FIG. 12 is an equatorial view of FIG. 11 with the completed parting line resulting from a superposition of secondary waveforms.

Referring to FIGS. 1 to 6, wherein an improved mold of the present invention is shown, with the mold being indicated by the reference numeral 20, the mold 20 having a spherical cavity 21 forming a cover for a golf ball wherein the mold 20 comprises hemispherical mold cups, an upper mold cup 22 and a lower mold cup 23, both cups having interior cavity details 24*a* and 24*b* (FIG. 6), and when mated define a dimple arrangement therein. The mold cups 22 and 23, as shown in FIGS. 5 and 6, provide a dimple pattern on the ball in an icosahedral dimple arrangement for example only. Any dimple arrangement, such as octahedral, cube-octahedral, dipyramid, and the like could have the dimple pattern. The upper and lower mold cups have mating surfaces 25 and 26 respectively, and in FIGS. 5 and 6, which show molds producing a corrugated parting line, each surface comprising a plurality of peaks 27 and valleys 28 which are created by multiple radii, whereby when assembled the parting line 29, as seen in FIGS. 8, 10, and 12, follows the dimple outline pattern and allows the dimple outline pattern of one mold cup to interdigitate with the dimple outline pattern of the mating mold cup, to form a golf ball of substantially seamless appearance.

A tapered interlock 33 is created by the mating of the mold cups 22 and 23. The upper mold cup 22 comprises a 360° projection rim 30, that is tapered (angled at ø) and the lower mold cup 23 comprises a 360° correlating recess 31 that is also tapered at a corresponding angle ø, which for the present invention is about 15 degrees. Upon the cups 22 and 23 being movable towards and away from each other and, when together, the cavity of each cup is in registration with the corresponding cavity of the other cup to collectively define the shape of a golf ball. The tapered interlock 33 provides for a near perfect registration, wherein the shift on the molded golf ball is minimized, and the parting line has a minimal amount of flashing that needs to be removed.

The mold cups 22 and 23 of the invention incorporating a tapered interlock are produced in the same manner as standard mold cups up until the machining of the parting line. When machining an interlock with standard flat parting line the projection rim 30 is applied typically from the outside diameter of the cavity and is machined with the angular projection (ø) on the parting line away from the interior cavity detail 24*a*. The mating mold cup is machined with the recess 31 to accept the taper as an annular depression. The flat parting line 29 is typically located at the base of the recess analogous to a tapered counter bore, see FIGS. 1 and 2. When the mold cups 22 and 23 are assembled the flat parting lines mate. The projection rim 30 and recess 31 form a tapered interlock to align the two cavity halves in near perfect registration, thereby minimizing shift on the molded ball.

The interlock on corrugated parting line cavities is machined basically the same way with the male projection and the female recess. The main difference is the parting line is machined to follow the profile of the equator dimples. Typically, the parting line, as it is machined, is offset from the equator dimples by at least 0.001 inch, as to not interfere with the dimple perimeter. This produces a wavy or corrugated formed parting line consisting of multiple radii forming peaks and valleys, see FIG. 3. Typically, the peaks (the highest point of the parting line) are located above the theoretical center of the cavity half and the valleys (the lowest point) are located below the theoretical center of the cavity half. This offset distance of the peaks and valleys can be as much as about half the dimple diameter or as little as 0.001 inch. Designs which incorporate as little as 0.01 inch offset, provide the benefit of interdigitating dimples, yet only producing a small amount of undercut in the cavity. This alternating geometry is consistent over the entire parting line surface.

When the cavity halves are assembled, the peaks 26 of the parting line 29 on one mold cup mate with the valleys 27 of the parting line 29 on the other half to provide a seamless appearance to the molded ball. The interlock projection rim 30 and recess 31 mate to provide a near perfect registration between the mold cups 22 and 23, as shown in FIG. 4. (Example of FIG. 4 displays a flat parting line but the interlock feature is the same whether the parting line is flat or corrugated.) The tapered interlock can also be designed to determine a parting line gap to control the flash thickness. Typically, the parting line thickness is determined by the amount of cover material sandwiched between the two mold cups. This may limit the mold closing. The upper mold cup 22 may be tapered to provide a positive stop such that the parting line thickness will be independent of the volume of material. Although this creates a greater amount of flash, it can help provide a more uniform ball size.

The cavity design of the present invention can be applied for any golf ball molding process including injection molding, compression molding and casting. It will work with the standard flat parting line as well as corrugated parting lines used to manufacture "seamless" golf balls which include corrugations that are all on one side of the equator, types that cross the equator, and those that are offset from the equator. The design of the present invention benefits golf manufacturing where perfect registration is desired between mold cups. This minimizes the shift on the molded ball allowing for more accurate buffing. This is especially beneficial for golf balls having a flat parting line, because the dimples therein can be placed very close to the cavity parting line. Due to the reduction in shift upon the ball, the need to remove excessive material to clean the vestige for the parting line is reduced. The result is a ball having a seam with a more pleasing appearance.

A molded golf ball 40 (which may include a core, core layers, and/or intermediate layers, and at least one cover layer), having a novel parting line configuration is described on FIGS. 7-12, with the location of the traditional equator indicated by 41. The novel parting line configuration can be described as the superposition of a base waveform λ1 with a secondary waveform λ2 (or waveforms having wavelengths that are substantially shorter than the base waveform).

The base waveform has a wavelength of $\lambda 1=\pi D/n$, where D is the diameter of the spherical mold cavity and n is an integer that depends on the dimple pattern, usually between 3 and 6. In other words λ1 is generally ⅓, ¼, ⅕, or ⅙ the circumference of the mold cavity. The secondary waveforms λ2 have shorter wavelengths that are generally between ¼ and 1/12 of λ1.

The base waveform λ1 makes an integral number of cycles around the equator or seam area of the molded golf ball 40. The specific number of cycles is dependent upon the geometric characteristics of the dimple pattern. For example. octahedron-based patterns typically employ a sub-pattern of dimples that is repeated four times around the equator of the ball. In cooperation with this, the base waveform will have four repetitions of its cycle in one trip around the equator, giving it a wavelength of ¼ of the circumference of the ball. Icosahedron-based patterns, shown in the present invention, usually have a five fold repetition around the equator, thus for the present invention they will usually employ a base waveform having a wavelength ⅕ the circumference of the ball.

Figure 7:
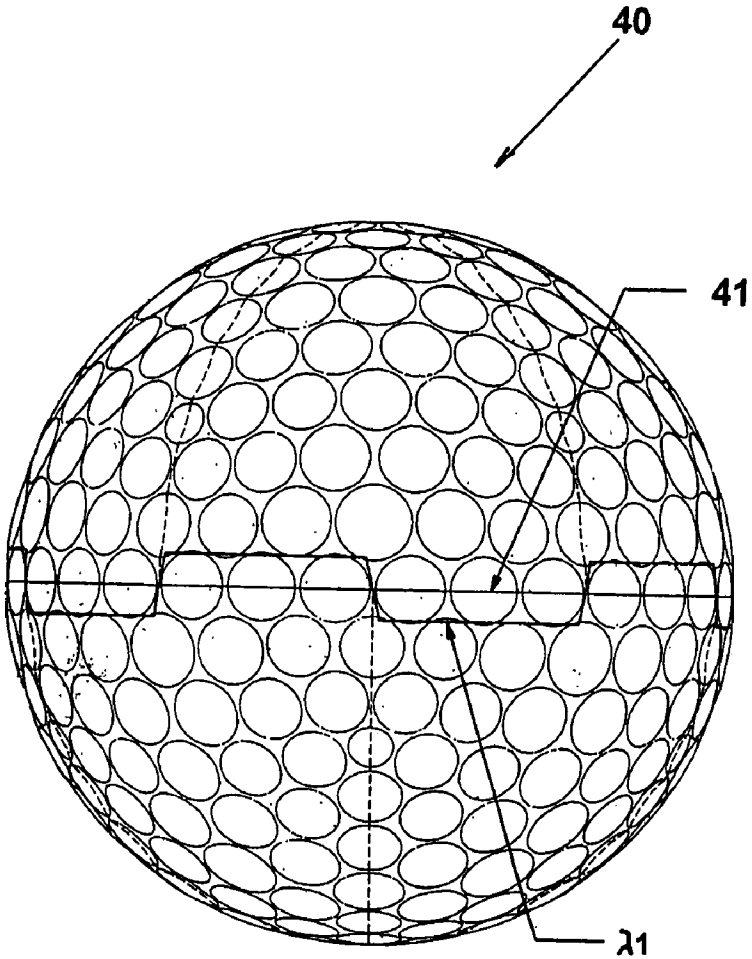
FIG. 7 is an equatorial view of a golf ball of the present invention with a parting line formed by a base waveform having a squared-off design.
Figure 9:
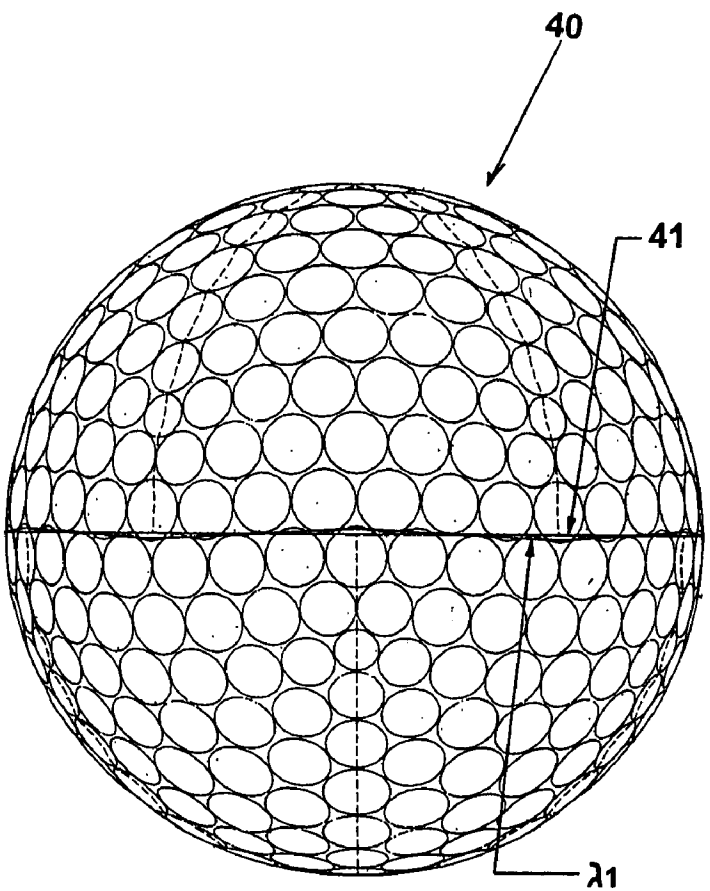
FIG. 9 is an equatorial view of an embodiment of a golf ball of the invention showing a base waveform having a "zig zag" design.
Figure 11:
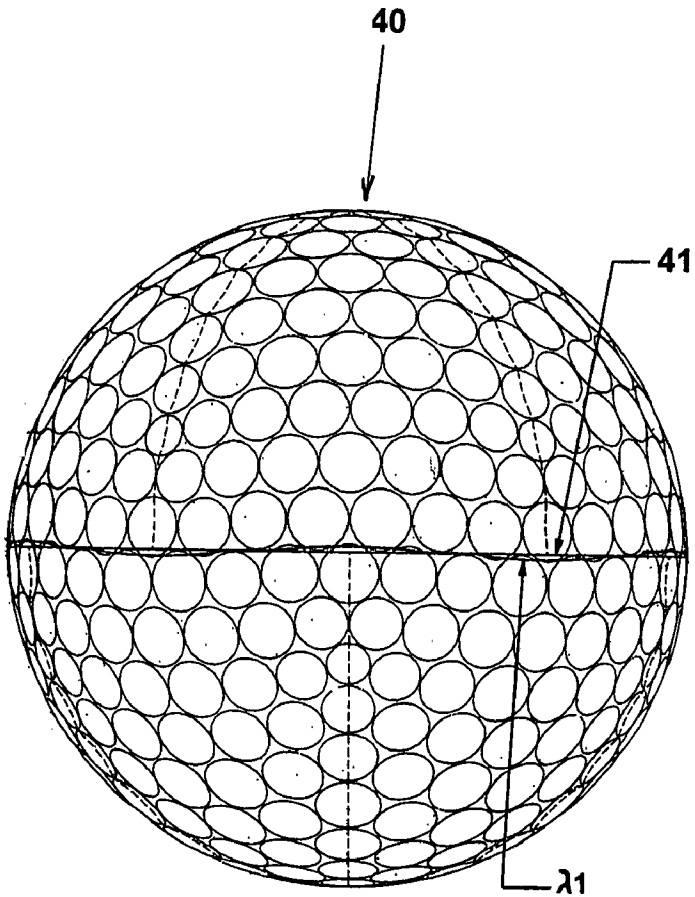
FIG. 11 is an equatorial view of an embodiment of the invention showing a base waveform comprising arch-shaped sections connected by segments that run coincident with the equator.

FIGS. 7, 9, and 11 show icosahedron-based dimple patterns with three different types of base waveforms λ1. The dashed lines delineate the dimple pattern segments that repeat five times around each hemisphere, as is typical for icosahedron patterns. Thus, each of these base waveforms completes five cycles around the equator area of the ball ($\lambda 1=\pi D/5$).

In FIG. 7, the dimple pattern has a row of dimples centered along the equator of the ball. The base waveform λ1 has a squared-off shape, alternating generally above and below the equator row of dimples.

FIG. 9 shows a different icosahedron-based pattern that does not have a row of dimples centered on the equator. Rather, it has a row of dimples on either side of the equator that is non-latitudinal or "wavy" in nature. One row resides predominantly in one hemisphere, while the other row resides predominantly in the other hemisphere. This embodiment employs a base waveform with a zig-zag shape.

FIG. 11 shows the same dimple pattern, but with a different base waveform. In this case, the waveform is made up of arch-shaped sections connected by segments that run coincident with the equator.

In FIGS. 7, 9 and 11, the base waveform λ1 will usually intersect at least some of the dimples on the ball. Thus, if it were to be used as a mold parting line path, the molded ball would have flash and other parting line defects within the boundaries of some of the dimples, complicating the finishing process. This problem is solved by the superposition of a secondary waveform λ2 upon at least portions of the base waveform λ1. This secondary waveform λ2 has a shorter wavelength that permits it to weave between and around the individual dimples, maintaining a space from the dimple edge and avoiding any intersections. For this secondary waveform λ2 in particular, the wavelengths of the individual cycles might vary somewhat, as necessary to maintain said spacing and avoid said intersections. Thus, the base waveform λ1 follows the dimple pattern as a whole, while the secondary waveform λ2 follows the individual dimples.

FIGS. 8, 10, and 12, show the completed parting lines 42 that result from the superposition of secondary waveforms λ2 upon the base waveforms λ1 of FIGS. 7, 9, and 11 respectively. It is to be appreciated, that unlike the base waveforms λ1 alone, the completed parting lines do not intersect any dimples and in fact maintain a spaced relationship from the dimple edges.

The secondary waveform λ2 may be continuous around the entire seam area of the ball, as in FIG. 10, or it may be broken into individual segments that are applied in a periodic fashion to the base waveform λ1, as on FIGS. 8 and 12. FIG. 12, shows a ball further distinguished by gaps between the secondary waveform segments. These gaps correspond to the sections of the base waveform that run coincidental with the equator.

In FIG. 8, λ2 is approximately ⅙ of λ1, while in FIGS. 10 and 12, λ2 is approximately ⅐ of λ1. It is not required that the individual segments of secondary waveform be λ2 identical to one another.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all modifications and embodiments, which would come within the spirit and scope of the present invention.

We claim as our invention:

1. A golf ball having a pattern of dimples and a corrugated parting line on its spherical surface, the golf ball formed in a mold which has a generally spherical cavity therein and is composed of upper and lower mold cups being removably mated along a parting surface at a position corresponding to an equator region of the spherical cavity of the mold, wherein the corrugated parting line of the golf ball comprises multiple radii forming a plurality of peaks and valleys which are offset from the dimples as not to interfere with the dimple edge and the dimples on one side of the parting line interdigitate with the dimples on the other side to form a gold ball having a substantially seamless appearance wherein the dimples of the molded golf ball are in a dipyramid pattern.

* * * * *